United States Patent [19]

Arnaud

[11] 4,047,509

[45] Sept. 13, 1977

[54] METHOD AND DEVICE FOR RECIRCULATING EXHAUST GASES OF INTERNAL COMBUSTION ENGINES

[75] Inventor: Henry Arnaud, Boulogne-Billancourt, France

[73] Assignees: Regie Nationale des Usines Renault, Boulogne-Billancourt; Automobiles Peugeot, Paris, both of France

[21] Appl. No.: 572,873

[22] Filed: Apr. 29, 1975

[30] Foreign Application Priority Data

May 16, 1974 France ..... 74.16996

[51] Int. Cl.[2] ..... F02M 25/00

[52] U.S. Cl. ..... 123/119 A; 123/124 R; 261/63

[58] Field of Search ..... 123/119 A, 124 R; 261/63 A

[56] References Cited

U.S. PATENT DOCUMENTS

| | | | |
|---|---|---|---|
| 2,154,417 | 4/1939 | Anderson | 123/119 A |
| 3,802,402 | 4/1974 | Swatmann | 123/119 A |
| 3,827,412 | 8/1974 | Waitzman | 123/119 A |
| 3,844,260 | 10/1974 | Scott | 123/119 A |

*Primary Examiner*—Ronald H. Lazarus
*Attorney, Agent, or Firm*—Fleit & Jacobson

[57] ABSTRACT

This invention relates to a method and device for recirculating the exhaust gases of internal combustion engines, utilizing means for injecting said gases into the engine induction manifold while mixing them with an adjustable-output induction air circulation controlling indirectly the metering of the amount of recycled gases. A recirculation conduit connects one portion of the exhaust system to one portion of the induction manifold and connected to said recirculation conduit upstream of its junction with the induction manifold, an induction air pipe line incorporating an air output adjustment valve the opening of which is controlled as a function of the desired metered amount of recycled gases.

4 Claims, 2 Drawing Figures

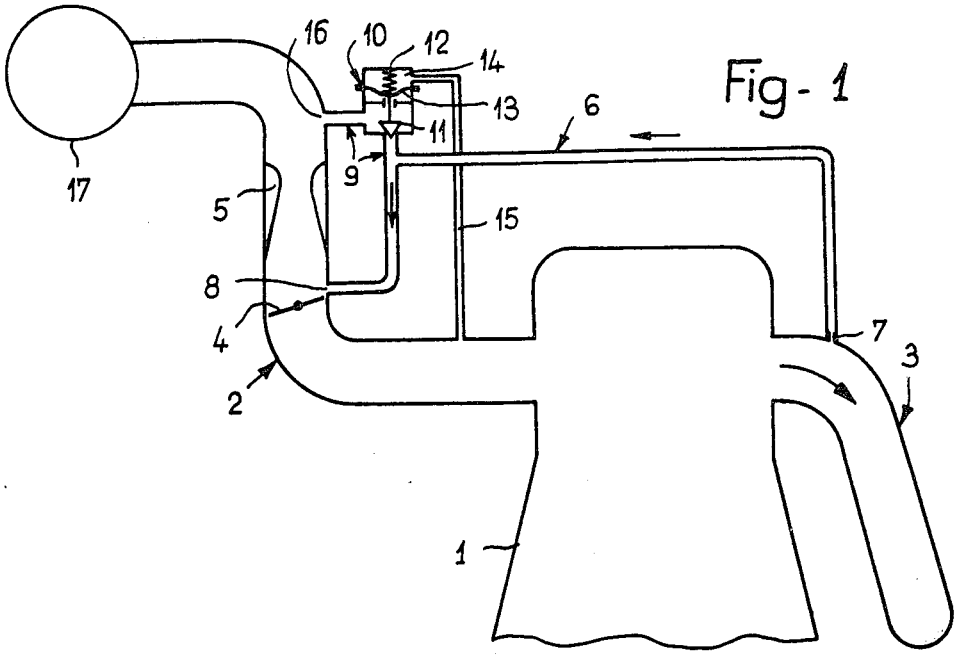
Fig - 1
Fig - 2
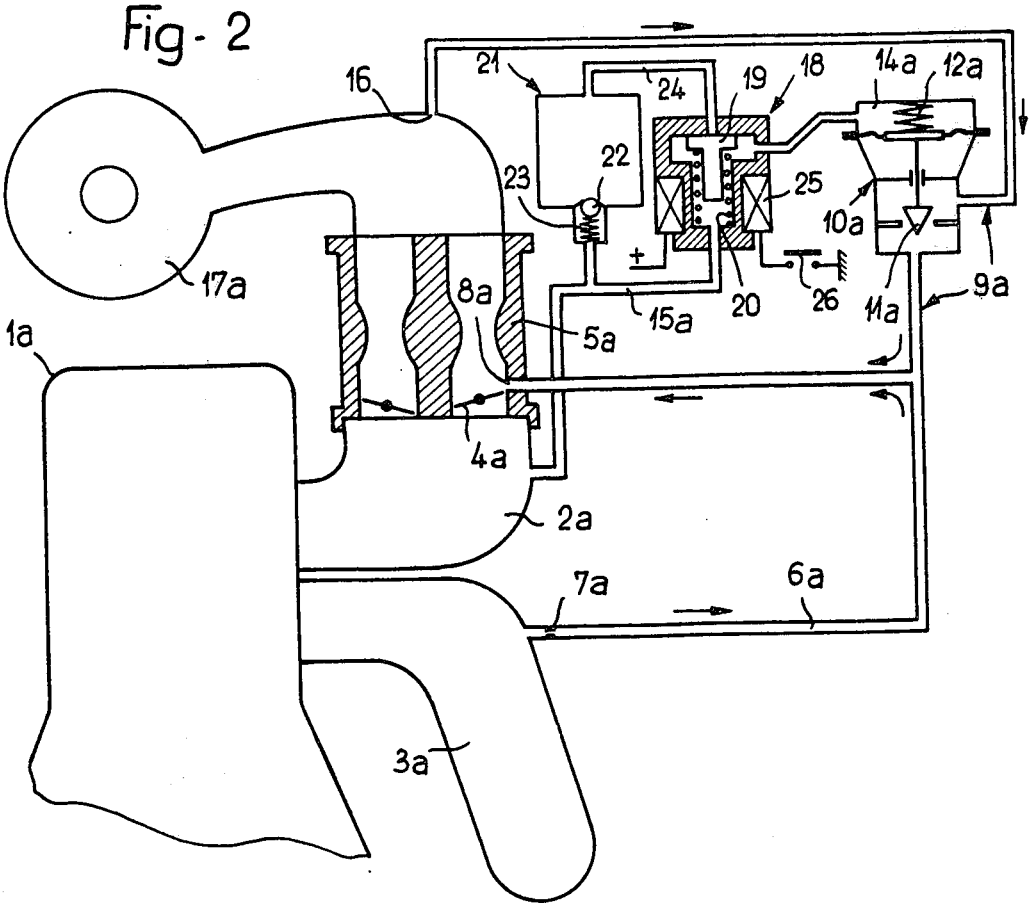

METHOD AND DEVICE FOR RECIRCULATING EXHAUST GASES OF INTERNAL COMBUSTION ENGINES

The present invention relates to a method of and a device for recirculating the exhaust gases of internal combustion engines in order to depollute these gases.

The more and more severe limitations concerning the release of nitrogen oxides contained in exhaust gases of internal combustion engines led to a general use of exhaust gas recirculation systems capable of producing relatively high recirculation rates in a wide range of operation. This trend implies the replacement of "open-and-shut" recirculation systems by gradual systems, the only ones capable of affording high recirculation rates rationally while preserving a normal driving impression and keeping the fuel consumption within reasonable limits.

In known exhaust gas recirculation systems, whether of the "open-and-shut" or gradual or progressive type, the output of recirculated gas is controlled directly by the passage of said gases through a gas recirculation valve the opening of which is adapted to be controlled through mechanical, electro-mechanical or pneumatic means (connected to the throttle control, to the induction manifold suction, to the exhaust manifold or to a Venturi inserted in the induction system, etc.

Since high temperature gases are caused to flow through these valves, their service conditions are particularly detrimental and hardly consistent with a reliable and accurate operation.

It is the essential object of the present invention to provide a method of and a device for recirculating exhaust gases of internal combustion engines while operating under particularly reliable and accurate conditions and eliminating notably the aforesaid inconvenience due to the passage of high temperature gases through a gate valve or non-return valve.

For this purpose the exhaust gas recirculation method according to this invention is characterised essentially in that it consists in injecting said gases into the induction manifold of the engine while mixing them with an adjustable output circulation of induction air, the air output adjustment controlling indirectly the metered amount of recycled exhaust gases.

This invention is also concerned, more particularly, with means for adjusting the output of air mixed with the gases as an inverted function of the engine load.

On the other hand, the device for recirculating exhaust gases of internal combustion engines according to this invention, which comprises a recirculation conduit connecting one portion of the exhaust system to one portion of the engine induction manifold, is characterised essentially in that it comprises an induction air pipe connected to said recirculation conduit upstream of its junction point with said induction manifold, said air pipe incorporating an air output adjustment valve controlled as a function of the desired metered amount of recycled gases. This valve may be controlled for example as a function of the negative pressure prevailing in the induction manifold downstream of the engine power adjustment butterfly valve or throttle.

Other features of this invention will appear as the following description proceeds with reference to the attached drawing illustrating diagrammatically by way of example two typical forms of embodiment of the invention. In the drawing:

FIG. 1 is a fragmentary diagrammatic view of an engine equipped with a first embodiment of the exhaust gas recirculation system of this invention, and FIG. 2 is a similar view showing a modified form of embodiment.

The petrol internal combustion engine 1 is shown only diagrammatically in FIG. 1, with its induction manifold or pipe 2 and exhaust manifold or pipe 3. In the induction manifold 2 the conventional throttle or butterfly valve 4 for controlling the engine power output is shown diagrammatically; this valve may be the conventional one controlling the delivery of the air/fuel mixture to the engine in the case of a carburettor engine, in which case the choke-tube is disposed upstream of said valve, as shown at 5; alternatively, this valve may be the air induction adjustment member in the case of an engine equipped with a direct or indirect fuel injection system.

An exhaust gas recirculation conduit 6 branched off the exhaust pipe 3 comprises at its initial end a gauged orifice 7 and is connected to the induction manifold 2 at 8, just upstream of the throttle valve 4 in the adjustment position thereof illustrated in thick lines, which is the engine idling position.

An air induction pipe 9 connected to said recirculation conduit 6 upstream of the junction point 8 incorporates an air output adjustment valve 10. This valve actually comprises a valve member or shutter 11 urged to its closed position by a spring 12 and connected to a membrane 13 enclosed in a vacuum-controlled chamber 14 connected in turn via a pipe line 15 to the induction manifold 2, downstream of said throttle valve 4. The air induction pipe 9 is branched off the air induction manifold at a point 16 located upstream of the aforesaid point 8 and of the carburettor, if provided, this induction taking thus advantage of the filtration of the induction air by the conventional filter 17.

This device operates as follows:

When starting the engine and notably at idling speed, the above-defined point 8, due to the position of the recirculation conduit 6 upstream of the throttle valve 4 in the idling position thereof, is substantially at the same pressure as point 16, and though the valve member 11 is fully open due to the vacuum prevailing downstream of said throttling valve 4, only a very moderate air flow takes place between said points 16 and 8, with only a very moderate recirculation of exhaust gases to the point upstream of the throttling valve 4 where the prevailing pressure approximates the atmospheric value. Thus, the moderate existing recirculation is not likely to interfere with the engine idling and the low engine speeds obtained during the initial opening of said throttle valve, and the shape of the connecting orifice at 8 may be adapted to this end in the form of a circular hole or a slot, for instance.

Under low engine loads such that the edge of throttle valve 4 is above the connecting orifice 8 so that the latter opens downstream of said valve, the valve member 11 is still held in its fully open position and the air put through in induction pipe 9 has its maximum value, whereby the recirculation gas output has a relatively low value.

As a function of the increment in the engine load the valve member 11 is gradually closed and the air output in conduit 9 is progressively reduced, this being beneficial to the recirculation gas output the value of which increases until valve member 11 is closed completely. The amount this valve member 11 is fully closed (this occurring when the throttle valve 4 is in its fully open position) the recirculation gas output eventually tends to decrease due to the reduction in the pressure differential existing between the exhaust manifold and the induction manifold.

It is thus clear that the recirculation of exhaust gases is controlled essentially by the air output flowing through the valve device 10, without any risk of causing the exhaust gases flowing therethrough to escape from, or soot up, said device 10.

FIG. 2 illustrates a modified arrangement of the device of this invention which is advantageous in that it affords a corrective action to the operating conditions set forth hereinabove when starting and running a cold engine. In this arrangement the various components also found in the arrangement of FIG. 1 are designated by the same reference numerals plus the indicia "a".

This arrangement further comprises, inserted in pipe line 15*a*, a solenoid operated valve 18 having a two-position or two-way valve member 19, one position being obtained in the inoperative condition by means of a spring 20 whereby the pipe line 15*a* normally provides the communication between the vacuum control chamber 14*a* of valve device 10*a* and the induction manifold 2*a* as in the preceding example. Branched off the pipe 15*a* is a vacuum reservoir 21 provided with a suction and holding valve 22 urged to its closed position by a spring 23 calibrated to the vacuum value corresponding to that required in control chamber 14*a* for fully opening the valve member 11*a*, said reservoir 21 being connected via a pipe line 24 to the solenoid operated valve 18; however, this pipe line 24 is normally closed by valve member 19.

The solenoid 25 of valve 18 may be energised via a heat-responsive switch consisting in this example of the valve switch 26 which is adapted to close below a predetermined temperature and so disposed for example in the engine water cooling system as to open when the threshold temperature is attained.

Thus, when starting the cold engine and running same before its rated temperature is attained, the valve member 19 attracted by the energized solenoid 25 cuts off the normal communication established via pipe line 15*a* and causes the vacuum reservoir 21 to communicate with the vacuum chamber 14*a* controlling the valve member 11*a* of valve device 10*a*, so that this device remains wide open and the induction air circulation through this valve is kept at its maximum value; in other words, the exhaust gas recirculation is kept at its minimum value until the normal running temperature of the engine is attained, as controlled by said switch. Then, the device operates exactly like the device described hereinabove with reference with FIG. 1.

It may be pointed out that, of course, other means than vacuum may be used as a parameter for adjusting the induction air output in valves 10 and 10*a*, and that the opening of these valves may be controlled independently of the actuation of the engine power output control throttle acting in the direction to close the valves when the throttle valve is opened.

Of course, other modifications and changes may be contemplated by those skilled in the art without departing from the basic principles of the invention as set forth in the appended claims.

What is claimed is:

1. A method of recirculating the exhaust gases of internal combustion engines having an induction manifold, an engine power output adjustment throttle valve, and an exhaust system comprising the steps of, injecting exhaust gases from the exhaust system directly into the induction manifold, mixing atmospheric air with the exhaust gases to be injected into the induction manifold prior to said injecting step and adjusting the amount of air to be mixed with the exhaust gases prior to said mixing step to thereby control indirectly the metering of the amount of recycled exhaust gases without passing recycled exhaust gases through a gas recirculation control valve wherein said mixing step is carried out by providing an adjustable output induction air circulation in parallel with the induction manifold and wherein said injecting step is carried out by injecting the mixture of exhaust gases and atmospheric air just upstream of the throttle valve to provide atmospheric pressure at the output of the air circulation at engine idling speed.

2. A device for recirculating the exhaust gases of internal combustion engines having an induction manifold and an exhaust system which comprises, a recirculation conduit connecting one portion of the exhaust system to one portion of the engine induction manifold, an induction air pipe line connected at one end to said recirculation conduit upstream of its junction with the induction manifold, an air output adjustment valve in said air induction pipe line, and means for controlling the opening of said air output adjustment valve as a function of the desired metering of the amount of recycled exhaust gases to control the amount of atmospheric air introduced in said recirculation conduit, wherein the engine includes a power output adjustment throttle valve and wherein the opening of said air output adjustment valve is controlled by said controlling means as a function of the vacuum prevailing in the induction manifold downstream of the throttle valve whereby the metering of the recycled exhaust gases is provided without the exhaust gases passing directly through a gas recirculation control valve positioned in the recirculation conduit.

3. A device according to claim 2 wherein said air output adjustment valve comprises a vacuum-responsive control chamber, means including a two-way valve for connecting said control chamber to the induction manifold, a vacuum reservoir, said two-way valve being arranged in one position to normally maintain communication between said control chamber and the induction manifold and in a second position corresponding to the cold starting of the engine to communicate said vacuum reservoir with said vacuum-responsive control chamber.

4. A device according to claim 3 wherein said two-way valve comprises a solenoid-operated valve and a heat-responsive switch for controlling said solenoid-operated valve.

* * * * *